United States Patent [19]

Saget

[11] Patent Number: 4,729,760

[45] Date of Patent: Mar. 8, 1988

[54] APPARATUS FOR THE CENTRIFUGAL SEPARATION OF A MIXTURE OF PHASES

[76] Inventor: Pierre Saget, 36, Avenue de la Grande Armée, 75017 Paris, France

[21] Appl. No.: 876,694

[22] Filed: Jun. 20, 1986

[51] Int. Cl.[4] ..... B04B 5/12; B04B 15/08

[52] U.S. Cl. ..... 494/85; 209/144

[58] Field of Search ..... 209/144, 143, 148; 494/56, 47, 45, 40, 85; 55/459 R

[56] References Cited

U.S. PATENT DOCUMENTS

| | | | |
|---|---|---|---|
| 2,360,355 | 10/1944 | McBride et al. | 209/144 |
| 2,754,967 | 7/1956 | Lykken | 209/144 |
| 3,371,783 | 3/1968 | Meyer et al. | 209/148 |
| 4,398,932 | 8/1983 | Dehne | 209/144 |

FOREIGN PATENT DOCUMENTS

| | | | |
|---|---|---|---|
| 2061136 | 5/1981 | United Kingdom | 209/144 |

*Primary Examiner*—Harvey C. Hornsby
*Assistant Examiner*—Scott J. Haugland

[57] ABSTRACT

The apparatus according to this invention comprises, in a fixed enclosure, a rotating element constituted by a treatment rotor incorporating perforated discs offset angularly one from the other, upstream by a rotary distributor and downstream by a ventilator. According to the invention, the rotor is interposed between an upstream suction chamber and a downstream chamber collecting the gaseous phase, the rotor comprising a hollow shafting which places in communication through end openings this collecting chamber with the chamber of the ventilator, which is separated by a partition from the suction chamber, while the collecting chamber is separated by a partitioning from the peripheral zone and from a conical extension.

5 Claims, 1 Drawing Figure

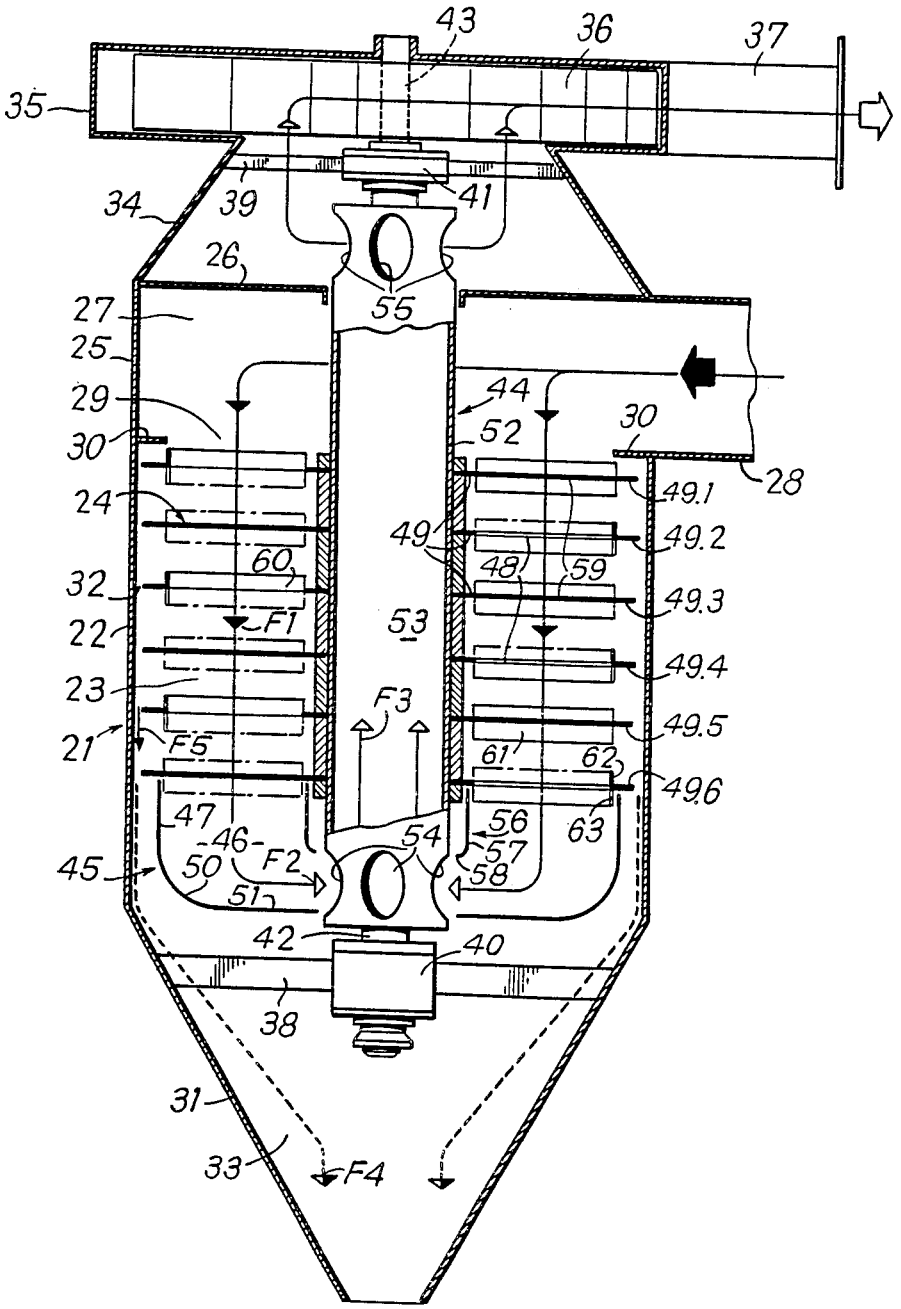
43
36
37
35
39
41
34
26
55
27
25
29
44
52
30
30
28
24
49.1
49
49.2
60
48
59
32
49.3
F1
53
22
49.4
23
F3
49.5
21
F5
61
62
49.6
47
46
56
63
54
57
45
50
F2
58
51
42
40
38
31
33
F4

APPARATUS FOR THE CENTRIFUGAL SEPARATION OF A MIXTURE OF PHASES

The present invention relates to an apparatus for the centrifugal separation of a mixture of phases, in accordance with the process described in French Pat. No. 2 468 410.

This French Pat. No. 2 468 410 also describes an apparatus comprising, in a fixed enclosure, a rotating element constituted by a treatment rotor incorporating perforated discs offset angularly one from the other, upstream by a rotary distributor and downstream by a ventilator with the possible interposition of a rotary diffuser, the mixture to be treated flowing in laminary manner through the perforations of the discs in active helicoidal streams rotating much more quickly than the rotor and separated by dead helicoidal sheets rotating substantially at the same speed as this rotor and in which the heavy phase to be separated passes between the discs as far as the fixed part of the enclosure where it is collected and evacuated.

In this known apparatus, the mixture to be treated and the heavy phase circulate in contra-flow. In fact, this apparatus being presumed to be of vertical axis, the chamber of the ventilator is disposed above the rotor whilst the jacket or suction chamber lies therebelow; the mixture to be treated therefore circulates from bottom to top, whilst the heavy phase precipitated on the wall of the fixed enclosure must circulate from top to bottom outside said jacket. Now, the functional clearance provided between the rotor and deflectors equipping the enclosure on its periphery and the clearance for evacuation of the heavy phase made between these deflectors and the fixed wall of this enclosure are the seat of an upward leakage flow. This leakage flow may in certain cases place part of the heavy phase which arrived at the periphery into suspension again in the separated light phase, which is detrimental to the yield of separation.

In order to overcome this drawback, French Patent Application No. 2 522 528 provides small axial blades on the periphery, which blades may be fixed or rotary.

Other means avoiding return of the heavy phase into suspension are recommended in French Patent Applications Nos. 2 535 215 and 2 535 216.

All these means give satisfactory results with certain types of mixtures, but they are not totally efficient with other types of mixtures.

It is an object of the present invention to improve the conditions of evacuation of the heavy phase extracted thanks to a positive assistance of the leakage flow, which, up to the present time, had an antagonistic effect. It proposes a novel organization of the apparatus thanks to which the leakage flow (combined with the principal flow) and the flow of the heavy phase are established on the uniflow model and develop a final phenomenon of cyclone in order to deposit the heavy phase without contact with the wall. Consequently, all types of mixtures may now be treated with an exceptional final yield of separation simply by selecting in advance either the contra-flow apparatus or the uniflow apparatus and possibly by applying to the apparatus selected the improvements mentioned above or others.

The apparatus of the invention comprises, in a fixed enclosure, like the known apparatus mentioned hereinabove, a rotating element constituted by a treatment rotor with perforated discs offset angularly from one another, upstream by a rotary distributor and downstream by a ventilator with the possible interposition of a rotary diffuser.

However, it differs from the known apparatus in that, in accordance with the invention, the treatment rotor is interposed between an upstream chamber for suction of the mixture to be treated and a downstream chamber collecting the separated gaseous phase, the rotor comprising a coaxial hollow tubular shafting which places in communication through end openings this collecting chamber with the chamber of the ventilator, which is separated in the enclosure by a partition from the suction chamber, whilst the collecting chamber is separated in the enclosure by a partitioning, on the one hand, from the peripheral zone in which arrives the separated heavy phase and is established a helicoidal leakage flow in the same axial direction as the principal flow of the mixture through the rotor, on the other hand, from a conical extension of the enclosure forming cyclone and receiving the leakage flow charged with heavy phase to trap and collect the latter.

The upstream suction chamber preferably comprises a tangential admission pipe.

The partitioning of the downstream chamber for collecting the light phase comprises a bowl of which the cylindrical wall substantially extends the peripheral envelope of the perforations of the discs and is joined by a rounded part to a bottom surrounding the tubular shafting in the vicinity of its openings.

The invention will be more readily understood on reading the following description with reference to the accompanying drawings, in which:

The single FIGURE shows an axial section of the apparatus according to the invention, with vertical axis.

The apparatus illustrated in the drawing is of vertical axis, but it is obvious that this is not an imperative condition as the axis may be oblique and even, in certain cases, horizontal.

Referring now to the drawings, this apparatus comprises a fixed enclosure 21 presenting, if the axial direction of flow F.1 of the mixture to be treated, is considered, flow which is deflected in direction F.2 and directed in direction F.3 for the separated light phase:

- a cylindrical part 22 defining a treatment chamber 23 in which a rotor 24 is housed,
- a cylindrical part 25 defining with a partition 26 an upstream suction chamber 25, joined via a pipe 28, preferably tangential, to a source of mixture to be treated and permanently communicating with the treatment chamber 23 through a central annular passage 29 defined by an inner projecting flange 30,
- a truncated part 31 located on that side of the treatment chamber opposite that where the suction chamber 27 is located, this truncated part collecting a leakage flow of the mixture at the same time as the heavy phase coming from the peripheral zone 32 of the treatment chamber 23 and forming a cyclone 33 within which said heavy phase moves in the axial direction F.4 which is the same as that F.1 of the mixture to be treated through the rotor,
- a truncated part 34 extending the cylindrical part 25 and separated from the suction chamber 27 by partition 26, this truncated part forming a convergent,
- a spiral 35 for a suction rotor 36, the spiral communicating in its central zone with the convergent 34 and in its peripheral zone with a delivery pipe 37, two cross-pieces 38 and 39 fixed respectively in the truncated end parts 31 and 34, these cross-pieces being provided with bearings 40 and 41 for supporting the end journals 42 and 43 of a driving shaft 44 which is normally connected to a motor, an outer bowl 45 defining a downstream chamber 46 for collecting the light phase at the outlet of the rotor 24, the cylindrical wall 47 of this bowl substantially extending the outer envelope of perforations 48 of the discs 49 of the rotor and this wall 47 being joined by a rounded deviating part 50 to a bottom 51 surrounding a tubular portion 52 of the shafting 44 bearing the discs 49 of the rotor, which portion forms a coaxial conduit 53 for evacuating the light phase between the downstream chamber 46 and the convergent 34 with which it communicates via openings 54 and 55 respectively, and possibly an inner bowl 56 of which the cylindrical wall 57 substantially extends the inner envelope of the perforations 48 of the discs 49 of the rotor, the bottom 58 of this inner bowl 56 and the bottom 51 of the outer bowl 45 surrounding the tubular portion 52 of the shafting 44 as closely as possible without touching it, so that the openings 54 of this portion open out in the breeches chute formed by these bowls.

As is well known by French Pat. No. 2 468 410 for rotor 24, the discs 49.1 to 49.6 which are six in number in the example shown, but this figure is nonlimiting, are spaced apart from one another at constant pitch. Perforations 48 of each disc, which are preferably trapezoidal, are distributed equiangularly, extending from the centre towards the periphery (and widening in this particular case) and are separated by solid parts 59. Discs 49 are offset angularly from one to the following or to the preceding, so that the perforations are no longer located opposite one another, but define by steps helicoidal envelopes of privileged gradient with respect to the rotor. Inside such virtual envelopes flow active helicoidal streams of the mixture to be treated, if said streams are suitably accelerated by a rotary distributor constituted for example by the first disc 49.1; in fact, this distributor converts the upstream pressure drop in the suction chamber 27 into a helicoidal velocity of the mixture, so that the relative speed of rotation of the active streams due to this action is added in the same direction to the positive rotation speed of the distributor, therefore of the rotor. Outside these virtual envelopes stagnate or dwell dead helicoidal fluid sheets maintained prisoner of the rotor 24 between the solid parts 59 of the discs.

In fact, the rotor 24 divides the mixture to be treated into a plurality of intercalated dead helicoidal streams. The active streams, on passing through this rotor along said helicoidal paths, flow at an absolute tangential speed which is of course much greater than that of said rotor, whilst the dead sheets, by being prisoner of said rotor, circulate substantially at its tangential speed.

Under these conditions, it is ascertained that, for a rotor rotating at the same angular speed "$\omega$", the absolute tangential speed of a particle located at a radial distance R is:

$\omega R$ if this particle is located in a dead sheet, $\omega R + V_T$ if this particle is located in an active stream advancing with respect to the rotor at the substantially constant relative tangential speed "$V_T$".

Consequently, the centrifugal force of such a particle is:

$F_{CH} = \omega^2 R$ in a dead sheet, and $$F_{CV} = \frac{(\omega R + V_T)\,2}{R}$$

in an active stream.

It is clear that the centrifugal force $F_{CV}$ in the active streams evolves in conical variation along the radii. It is minimum at a point where the relative tangential speed of the stream is equal to the absolute tangential speed of the rotor; at that point, the minimum centrifugal force is equal to 4 $\omega^2 R$ and consequently to four times the centrifugal field which prevails on the circumference of the same radius in the dead sheets. The centrifugal force is very intense at the centre; it decreases up to the point where it attains its minimum; then it increases again up to the periphery where it may resume extremely intense values.

This results in that the heavy particles of the active streams 19 subjected to a very intense centrifugal force precipitate towards the periphery, slowing down and agglutinating before arriving at the annular zone of minimum force then, from this zone, accelerate again in greater masses towards the periphery. However, during this centrifugal displacement, the heavy particles migrate towards the dead sheets in which they are trapped; they are then taken over by a centrifugal force which is weaker but suffiently high to take them ineluctably towards the periphery; during this displacement, proeminent elements oppose the escape of the heavy particles towards the active streams and participate positively in their displacement towards the periphery where they precipitate on the cylindrical part 22 of the enclosure 21.

Such proeminent elements project solely in the dead sheets and must not appear, however little, in the active streams which they risk destroying or disturbing. Said proeminent elements cooperate with the solid parts 59 to maintain the dead sheets prisoner of the rotor, in order to confine in these sheets the heavy particles which escape from the active streams and positively guide said particles towards the periphery.

In accordance with the preferred, but nonrestrictive embodiment, shown in the drawing, each solid part 59 of a disc comprises on the edge of the adjacent perforations 48:

a substantially radial flange 60 which projects on the upstream face of this solid part (if the axial direction of flow Fl of the active streams is considered) and to the rear (if the direction of rotation of the discs is considered), a substantially radial flange 61 which projects on the downstream face of this solid part and at the front;

the perforations 48 may possibly be bordered by arcuate peripheral flanges 62 and 63 projecting on the upstream and downstream faces of the discs, these arcuate flanges 62, 63 extending the radial flanges 60, 61 without penetrating on the solid parts.

It is important to note that a leakage flow is established in the peripheral zone 32, this flow being supplied at a low flowrate principally by the dead sheets and being in helicoidal form in the axial direction F.5. This leakage flow is therefore charged with the separated heavy phase and moves in the same axial direction (arrows F.1 and F.5) as the mixture through rotor 24. These are therefore co-current flows which promote the displacement of the heavy phase towards part 31. Furthermore, a phenomenon of cyclone is established in that part, supplied by the leakage flow mentioned above and the heavy phase is stabilized in an intermediate zone (dotted), precipitating towards the open narrowed end. If the apparatus is vertical, the heavy phase is also subjected to gravity and in that case arrives more quickly at the open lower end.

What is claimed is:

1. An apparatus for the centrifugal separation of a mixture including at least one gaseous phase comprising a fixed enclosure, a rotatable element in said closure constituted by a treatment rotor incorporating perforated discs offset angularly one from the other, upstream by a rotatable distributor and downstream by a ventilator with the possible interposition of a rotatable diffuser, whereby the mixture to be treated flows in a laminary manner through the perforations of the discs in active helicoidal streams rotating much more quickly than the rotor and separated by dead helicoidal sheets rotating substantially at the same speed as said rotor and in which the heavy phase to be separated passes between the discs as far as a fixed part of the enclosure where it is collected and evacuated, said apparatus further comprising an upstream chamber for suction of the mixture to be treated and a downstream chamber for collecting the separated gaseous phase, said treatment rotor being interposed between said chambers and comprising a coaxial hollow tubular shafting, end openings in said shafting located in said collecting chamber which communicates said downstream collecting chamber with a chamber of said ventilator, a partition in said enclosure separating said chamber of said ventilator from the upstream suction chamber, and a further partitioning in said enclosure for separating the collecting chamber, on the one hand, from the peripheral zone of the enclosure in which the separated heavy phase arrives and there is established a helicoidal leakage flow in the same axial direction as that of the principal flow of the mixture through the rotor, and on the other hand from a conical extension of the enclosure forming a cyclone and receiving the leakage flow charged with heavy phase to trap and collect the latter.

2. The apparatus of claim 1, wherein the upstream suction chamber comprises a tangential admission pipe.

3. The apparatus of claim 1, wherein the further partitioning of the downstream chamber for collecting the light phase comprises a bowl of which a cylindrical wall substantially extends the peripheral envelope of the perforations of the discs and is joined by a rounded part to a bottom surrounding the tubular shafting in the vicinity of its openings.

4. The apparatus of claim 3, wherein the further partitioning of the downstream chamber collecting the light phase comprises a second bowl located inside the first said bowl in order to form a breeches chute, a cylindrical wall of this second bowl substantially extending the central envelope of the perforations of the discs, whilst its bottom extends on the side of the openings of the tubular shafting, opposite that where the bottom of the first bowl is located.

5. The apparatus of claim 1, wherein the enclosure has, between the upstream suction chamber and a chamber of the rotor, an annular flange projecting inside over at least the whole thickness of the peripheral zone collecting the heavy phase and the leakage flow, in order to contain this flow.

* * * * *